US009949570B1

(12) United States Patent
Young

(10) Patent No.: US 9,949,570 B1
(45) Date of Patent: Apr. 24, 2018

(54) BED WARMER SYSTEM

(71) Applicant: James C. Young, Lebanon, OH (US)

(72) Inventor: James C. Young, Lebanon, OH (US)

( * ) Notice: Subject to any disclaimer, the term of this patent is extended or adjusted under 35 U.S.C. 154(b) by 0 days.

(21) Appl. No.: 15/382,919

(22) Filed: Dec. 19, 2016

(51) Int. Cl.
*A47C 21/04* (2006.01)
*F24H 3/04* (2006.01)

(52) U.S. Cl.
CPC ..... *A47C 21/048* (2013.01); *F24H 3/0423* (2013.01)

(58) Field of Classification Search
CPC ..... A47C 21/00; A47C 21/04; A47C 21/042; A47C 21/044; A47C 21/048; A47G 9/0215; A61F 7/0097; F24H 3/0411; F24H 3/0417; F24H 3/0423; F24H 9/0057; F24H 9/0063
See application file for complete search history.

(56) References Cited

U.S. PATENT DOCUMENTS

| | | | | |
|---|---|---|---|---|
| 697,279 | A | 4/1902 | Schmied | |
| 1,121,277 | A | 12/1914 | Mitchell | |
| 2,042,264 | A * | 5/1936 | Levenhagen | F24H 3/0423 392/474 |
| 2,093,834 | A | 9/1937 | Gaugler | |
| 2,212,694 | A * | 8/1940 | McMurray | F24H 3/0423 392/385 |
| 2,250,325 | A | 7/1941 | Barnes | |
| 2,504,308 | A | 4/1950 | Donkle, Jr. | |
| 2,512,659 | A | 6/1950 | Williams | |
| 2,753,435 | A | 7/1956 | Jepson | |
| 2,978,225 | A | 4/1961 | Dallas, Jr. | |
| 3,560,710 | A * | 2/1971 | Fuellemann | B23K 1/012 219/501 |
| 3,757,366 | A | 9/1973 | Sacher | |
| 3,778,851 | A | 12/1973 | Howorth | |
| 4,114,620 | A | 9/1978 | Moore et al. | |
| 4,132,262 | A | 1/1979 | Wibell | |
| 4,867,230 | A | 9/1989 | Voss | |
| 4,884,304 | A | 12/1989 | Elkins | |
| 4,984,316 | A | 1/1991 | Simpson et al. | |
| 5,033,136 | A | 7/1991 | Elkins | |
| 5,730,120 | A * | 3/1998 | Yonkers, Jr. | A47C 21/044 128/202.13 |
| 5,871,151 | A | 2/1999 | Fiedrich | |
| 5,887,303 | A | 3/1999 | Raith | |
| 6,425,527 | B1 * | 7/2002 | Smole | F24F 7/00 236/49.3 |
| 6,468,234 | B1 | 10/2002 | Van der Loos et al. | |
| 6,473,920 | B2 | 11/2002 | Augustine et al. | |
| 6,581,224 | B2 | 6/2003 | Yoon | |
| 6,711,767 | B2 | 3/2004 | Klamm | |

(Continued)

*Primary Examiner* — Nicholas F Polito
(74) *Attorney, Agent, or Firm* — Mark F. Smithy; Smith Brandenburg Ltd

(57) ABSTRACT

A bed warming system for heating the envelop formed between the surface of a bed sheet covering a bed mattress and a cover laying over the bed sheet. The bed warming system comprises a warm air generator having a cool air inlet, a warm air outlet, and an elongated conduit having a first end connected to the cool air inlet for directing cool air to the warm air generator and a second end for receiving cooling air, the elongated conduit is of sufficient length such that when the warm air generator is placed under a cover the second end of the elongated conduit is exposed and not under the cover.

15 Claims, 14 Drawing Sheets

(56) References Cited

U.S. PATENT DOCUMENTS

| | | | | |
|---|---|---|---|---|
| 7,036,575 | B1 * | 5/2006 | Rodney | A47C 21/048<br>165/138 |
| 7,996,036 | B1 | 5/2011 | Marquette et al. | |
| 9,192,244 | B2 | 11/2015 | Rand | |
| 2003/0140418 | A1 * | 7/2003 | Klamm | A47C 21/022<br>5/423 |
| 2003/0188382 | A1 * | 10/2003 | Klamm | A47G 9/086<br>5/413 R |
| 2006/0085911 | A1 * | 4/2006 | Tompkins | A47C 21/048<br>5/423 |
| 2006/0101577 | A1 * | 5/2006 | Lussier | A47C 21/044<br>5/423 |
| 2006/0198617 | A1 | 9/2006 | Sirkis | |
| 2010/0011502 | A1 * | 1/2010 | Brykalski | A47C 21/044<br>5/423 |

* cited by examiner

BED WARMER SYSTEM

BACKGROUND OF THE INVENTION

People are often uncomfortable feeling when they first enter a bed because the bed and covers may be considerably colder than a person's body temperature thereby feeling cold to the touch. This uncomfortable feeling is enhanced during winter months or for older individuals that have poor circulation and are more sensitive to the cooler temperatures.

Various systems have been developed to heat the bedding thereby taking the chill off of entering the bed. One device that has been developed is the electric blanket comprising a fabric material having electric heating elements incorporated therein that heat to distribute heat along the surface of the bed. While electric blankets provide heat such that a person entering the bed will not be chilled, many users do not wish to wait for the blanket to heat or feel comfortable about sleeping under an electric blanket. Further, users often prefer sleeping under conventional blankets rather than an electric blanket and only desire to have a system that heats just prior to entering the bed.

Other systems that have been developed include warm air supplies that operates to blow hot air through one or more an elongated tubes into the cavity formed between a bed sheet and a overlaying cover. In some systems the tubes or conduits operate to direct the warm air into the cavity. Other systems include inflatable members for receiving heated air and are inserted under a bed cover. The inflatable members include a plurality of holes allows that allow the hot air to escape from the members to heat the underside of the cover. While such systems do operate to heat the bed and covers they must be inserted under the bed cover which often is somewhat time consuming. Further, users often want to sleep under the cover of choice and do not want to sleep under the inflatable member or a plurality of interconnected tubes or conduits. This is particularly true if one is traveling and the bed has already been made.

While many prior art systems operate having integrated warm air supplies, systems have also been developed that connect to independent conventional portable warm air supplies, such as a conventional hair dryer having an air inlet and a warm air outlet. The warm air outlet is connected to an elongated tube or conduit that operates to direct the warm air under a bed cover. In operation, the hair dryer is placed on the floor or a counter near the bed and the elongated tube or conduit is inserted under the bed cover such that warm air is blown into the envelope between the bed sheet and the cover lying over the bed sheet. While such systems are more convenient than other bed warming systems, particularly for placement when the bed has already been made or for use with beds when traveling, such as hotel beds, the systems require relatively long tubes or conduits for directing the warm air from the outlet of the warm air supply positioned on the floor or on a stand near the bed to the center of near the center of the bed. Accordingly, this results in the systems that are relatively large making them less portable and requires more effort in set-up and use. Further, warm air traveling along such elongated tubes and conduits will often cool substantially before the warm air travels under the bed cover. Such heat loss can be significant depending on the location of the warm air supply and the temperature in the room thereby significantly decreasing the efficiency of the system and the time to heat the bed covers.

Accordingly, it would be desirable to have a portable bed warming system that overcomes the disadvantages of the systems and devices described herein above, that can be easily inserted under the cover of a bed and easily removed, that is relatively light weight, compact, and can quickly and effectively heat up the space between a bed sheet and a bed cover and is relatively inexpensive to manufacture.

SUMMARY OF THE INVENTION

The subject invention is a new and novel bed warming system for heating the envelop formed between the surface of a bed sheet covering a bed mattress and a cover laying over the bed sheet. In a preferred embodiment of the invention the bed warming system comprises a warm air generator having a cool air inlet, a warm air outlet, and an elongated conduit having a first end connected to the cool air inlet for directing cool air to the warm air generator and a second end for receiving cooling air, such that when the warm air generator is placed under a cover the second end of the elongated conduit is exposed and not under the cover thus, preventing overheating of the warm air generator and by adjusting the length of the elongated conduit a user can place the warm air generator completely under the bed cover in any desired location and direction.

In a preferred embodiment of the invention the elongated conduit includes a plurality of air holes that operate to permit cool air to enter the elongated conduit.

In another preferred embodiment of the invention the elongated conduit is removably attached to the cool air inlet of the warm air generator.

In another preferred embodiment of the invention the bed warming system includes a timing system that operates to turn off (or on) the warm air generator after a predefined amount of time.

In another preferred embodiment of the invention the bed warming system includes a temperature sensor and switch that operate to turn off the warm air generator when the air temperature in the envelop formed between the cover and the bed sheet reaches a predefined temperature.

In another preferred embodiment of the invention the bed warming system includes a temperature sensor and switch that cooperates with the warm air generator to maintain the temperature in the envelop formed between the cover and the bed sheet within a predefined temperature range.

In another preferred embodiment of the invention the bed warming system includes a temperature sensor that operates to turn off the warm air supply generator if the temperature within the warm air generator reaches a predefined temperature.

In another preferred embodiment of the invention elongated conduit is formed from a flexible material capable of being bent or curved.

In another preferred embodiment of the invention the elongated conduit is expandable and retractable to provide different length of conduit.

In another preferred embodiment of the invention the elongated conduit is formed from two or more removable sections that connect together to lengthen the elongated tube.

In another preferred embodiment of the invention the removable sections of the elongated conduit are attached together by a snap, screw, frictional slid fitting or other suitable means for removably attaching the removable sections together.

In another preferred embodiment of the invention the elongated conduit is attached to the warm air generator by a flexible sleeve.

In another preferred embodiment of the invention the elongated first end of the elongated conduit includes an attachment effective for attaching to the cool air inlet by a snap, screw, frictional slid fitting or other suitable means for removably attaching the first end of the conduit to the cool air inlet.

In another preferred embodiment of the invention the warm air generator includes a holder effective for maintaining a distance between the warm air outlet and the bed sheet.

In another preferred embodiment of the invention the warm air generator includes a warm air outlet extender.

Other advantages, objects, and embodiments of the invention will be apparent from the following description, the accompanying drawings and the appended claims.

BRIEF DESCRIPTION OF THE DRAWINGS

To provide a more complete understanding of the present invention and further features and advantages thereof, reference is now made to the following description taken in conjunction with the accompanying drawings, in which.

DETAILED DESCRIPTION OF THE INVENTION

The subject invention is a new and novel bed warming system for heating the envelop formed between the surface of a bed sheet covering a bed mattress and a cover laying over the bed sheet. As used herein, the term "cover" refers to a sheet, blanket, and other such objects that a person typically sleeps under when in bed. The term "bed sheet" refers to a sheet, bed spread or other such objects that cover a bed mattress and that a person typically sleeps above. As used herein the term "ambient air" refers to air that exists outside, such as inside a room, and is not located in an envelope or space located under the cover and above the bed sheet.

Figure 5:
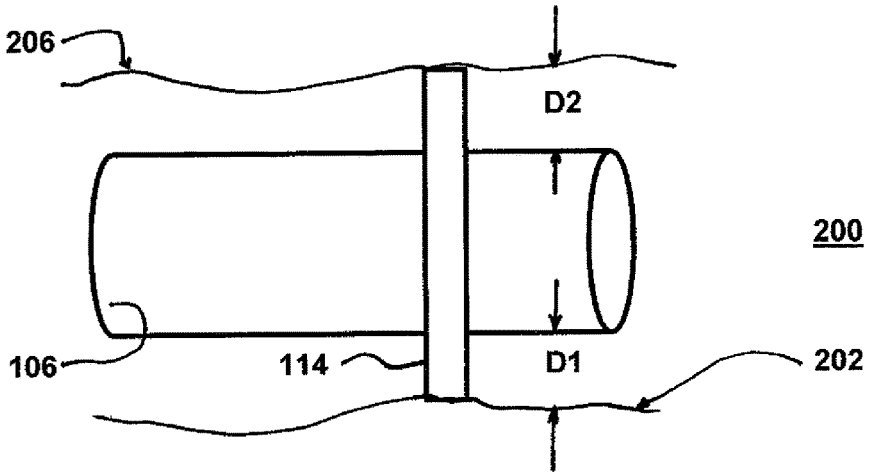
FIG. 5 is a schematic representation of another preferred embodiment of the invention showing an outlet holder effective for maintaining a distance between the warm air outlet and the bed sheet.

Referring to FIGS. 1-4, a preferred embodiment of the bed warming system for heating the envelop 200 formed between the surface of a bed sheet 202 covering a bed mattress 204 and a cover 206 laying over the bed sheet 202. In a preferred embodiment of the invention the bed warming system 100 comprises a warm air generator 102 having a cool air inlet 104, a warm air outlet 106, and an elongated conduit 108 having a first end 110 connected to the cool air inlet 104 for directing cool ambient air 208 to the warm air generator 102 and a second end 112 for receiving the cool ambient air 208, such that when the warm air generator 100 is placed under a bed cover 206 the second end 112 of the elongated conduit 108 is exposed and not under the bed cover 206. In a preferred embodiment the elongated conduit 108 includes a plurality of holes 109 that operate to permit cool ambient air to A enter the conduit thereby reducing stress on the warm air generator 102. As shown in FIG. 5, another preferred embodiment of the invention includes an outlet holder 114 permanently or removably connected to the warm air outlet 106 and is effective for maintaining a distance D1 between the warm air outlet 106 and the bed sheet 202 and for maintaining a distance D2 between the warm air outlet 106 and the bed cover 206 thereby minimizing the likelihood blockage of the warm air outlet 106 and the overheating and shutdown of the warm air generator 102. It should now be apparent to one skilled in the art that the outlet holder 114 operates to improve the ability of warm air circulating through the space or envelope 200 and the distances D1 and D2 are effective for reducing the likelihood of an undesirable hotspot forming on the bed sheet 202 or bed cover 206.

Figure 1:
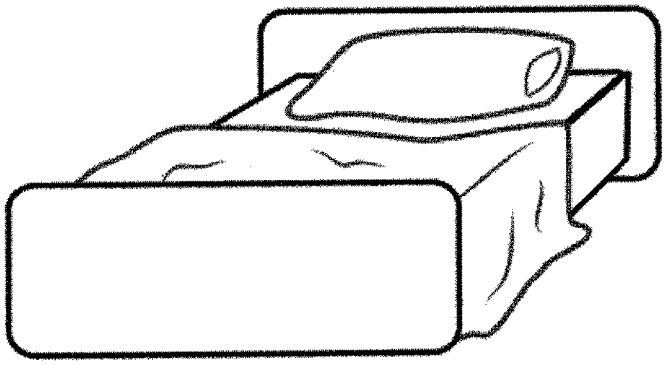
FIG. 1 is a schematic illustration of the bed warming system of the subject invention in position such that the warm air generator is positioned under a cover on a bed and having an elongated conduit extending outwardly from the bed cover and having a first end for receiving cool ambient air and directing it to the cool air inlet of the warm air generator.
Figure 2:
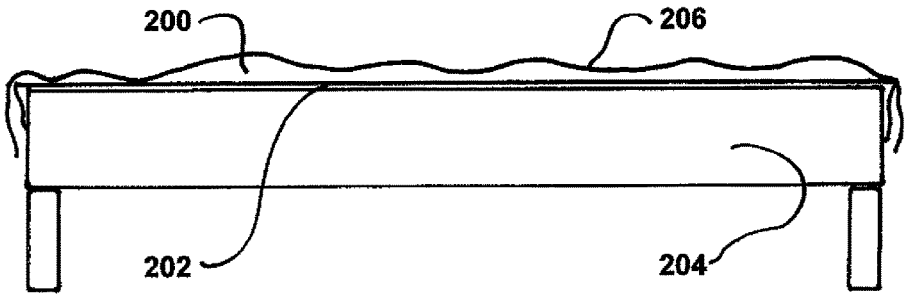
FIG. 2 is a schematic illustration showing a bed having a bed mattress and a bed sheet extending over the bed mattress and a cover extending over the bed sheet and forming an envelope or space between the bed sheet and cover.
Figure 3:
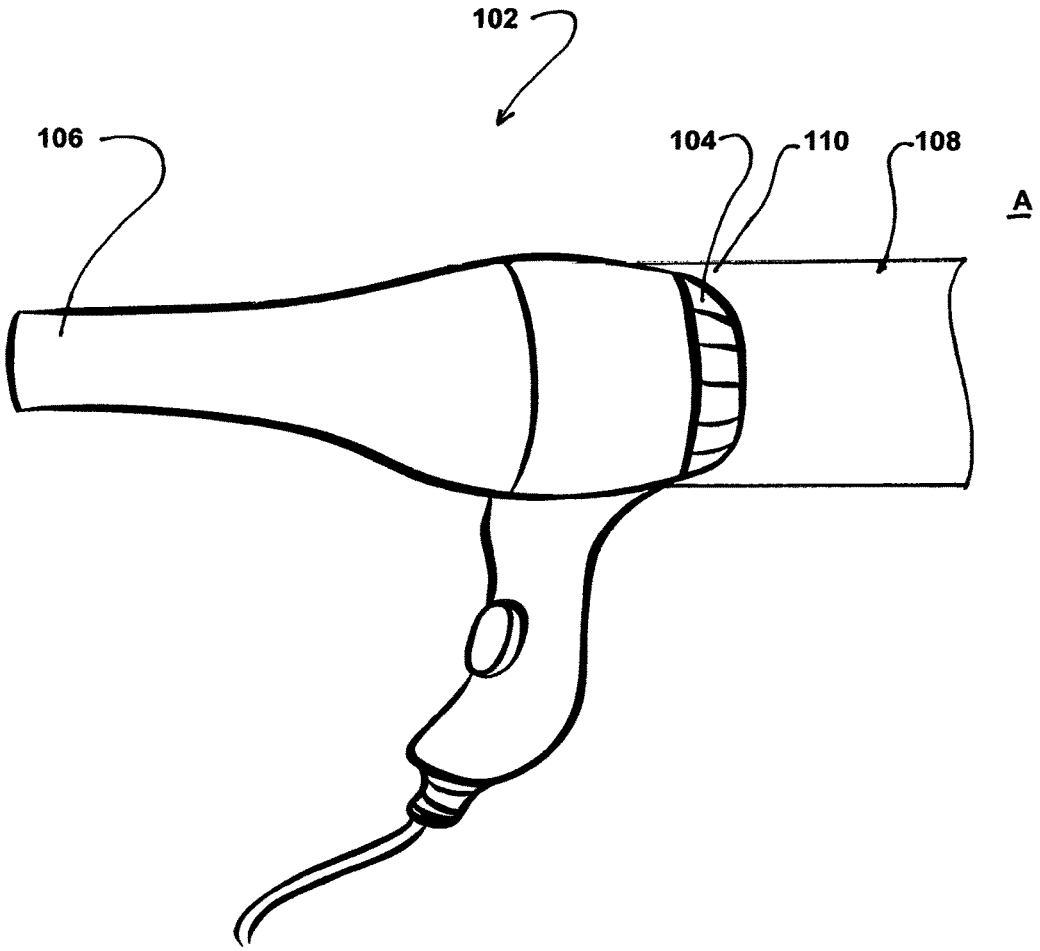
FIG. 3 is a schematic illustration of a preferred embodiment of the bed warming system of the subject invention showing a warm air generator having a cool air inlet, a warm air outlet, and an elongated conduit having a first end connected to the cool air inlet for directing cool air to the heating element of the warm air generator and a second end for receiving cooling ambient air.
Figure 4:
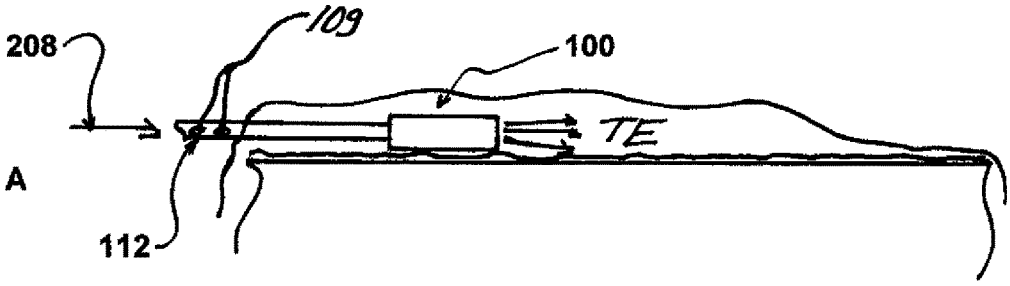
FIG. 4 is a schematic illustration of a preferred embodiment of the bed warming system of the subject invention showing the warm air generator placed under a bed cover the second end of the elongated conduit extending outwardly from the cover such that it is exposed to ambient air.
Figure 6:
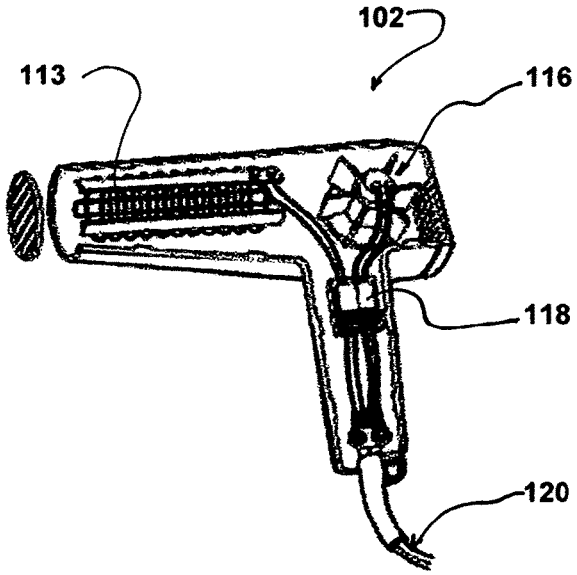
FIG. 6 is a skeletonized schematic illustration of another preferred embodiment of the invention showing the bed warming system having a temperature control system incorporated therein.
Figure 7:
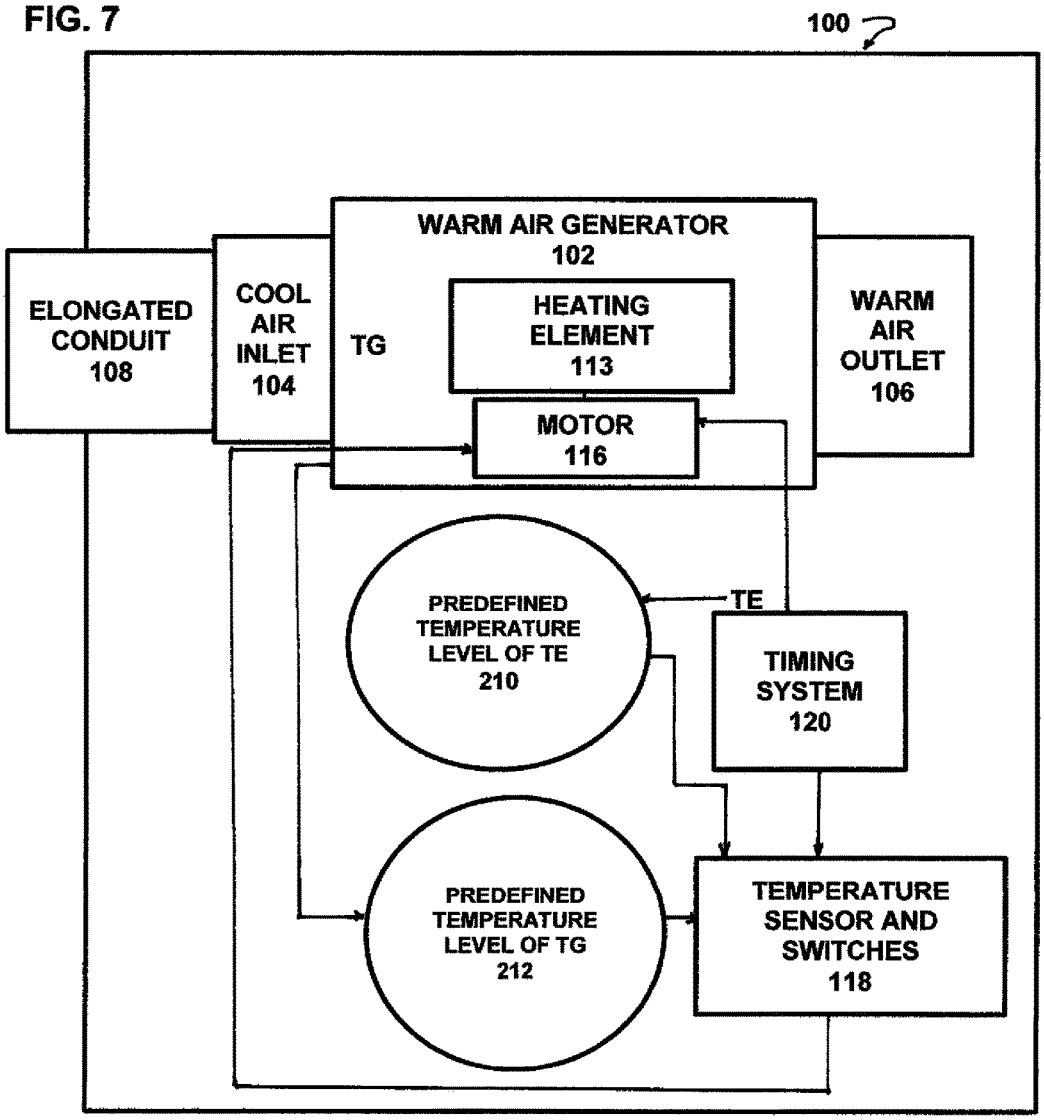
FIG. 7 is a schematic representation showing a preferred embodiment of the bed warming system having a warm air generator, temperature sensors and switches and a timing system.

In a preferred embodiment of the invention, as shown in FIG. 6, the warm air generator 102 is a conventional hair dryer, having an air heating element 113, such as an electrical resistance element for heating air, and a motor 116 for drawing cool air through a cool air inlet 104 and a warm air outlet 106 (FIG. 3). Preferably, as illustrated in FIGS. 6 and 7, the bed warming system 100 comprises one or more temperature sensors and switches 118 that may be integrated into the warm air generator 102 or may be separate and electrically connected to the electrical system 120 powering the heating element 113 and motor 116 of the warm air generator 102. In a preferred embodiment the bed warming system 100 includes one temperature sensor and switch 118 that operates to turn the warm air generator 102 off when the temperature TE (FIG. 4) of the air within the open space or envelop 200 formed between the bed sheet 202 and a cover 206 reaches a predefined level 210. In another preferred embodiment of the invention one temperature sensor and switch 118 operates to turn off the warm air generator 102 when the temperature TG within the warm air generator reaches a predefined temperature 212. It should be understood that the temperature sensor and switches 118 can be conventional temperature sensors and switches such as conventional electrical or an electro-mechanical sensors and switches. In another preferred embodiment of the invention the bed warming system 100 includes a timing system 120 that operates to turn off the warm air generator 102 after a predefined amount of time. It should be understood that the predefined amount of time can be fixed or the timing system can be adjustable such that a user can increase or decrease the amount of time that the bed warming system operates before being turned off. It should also be understood that the timing system can operate such that the warm air generator is turned off after a predefined amount of time and turns on after another predefined amount of time and that the sequence can continue as desired by the user.

Figure 8:
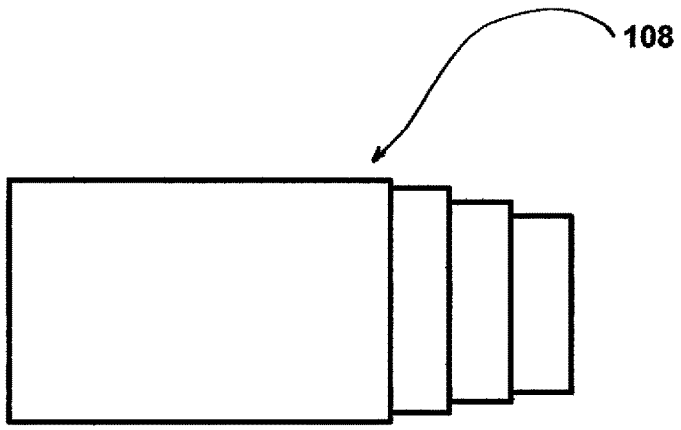
FIG. 8 is a schematic representation of another preferred embodiment of the invention showing the elongated conduit in the form of a telescoping tube, shown in it extended configuration, that is expandable and retractable to provide different length of conduit.
Figure 9:
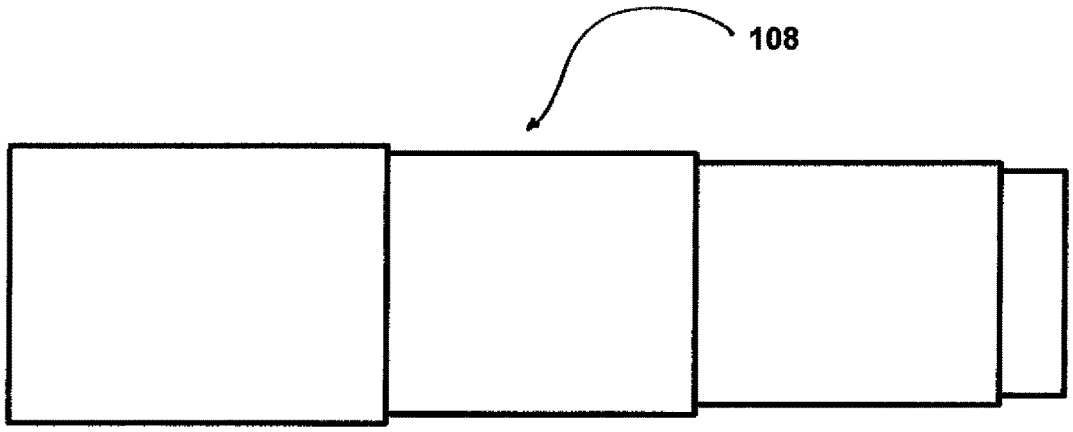
FIG. 9 is a schematic representation of the elongated conduit of FIG. 8 in the form of a telescoping tube shown it is retracted configuration.
Figure 10:
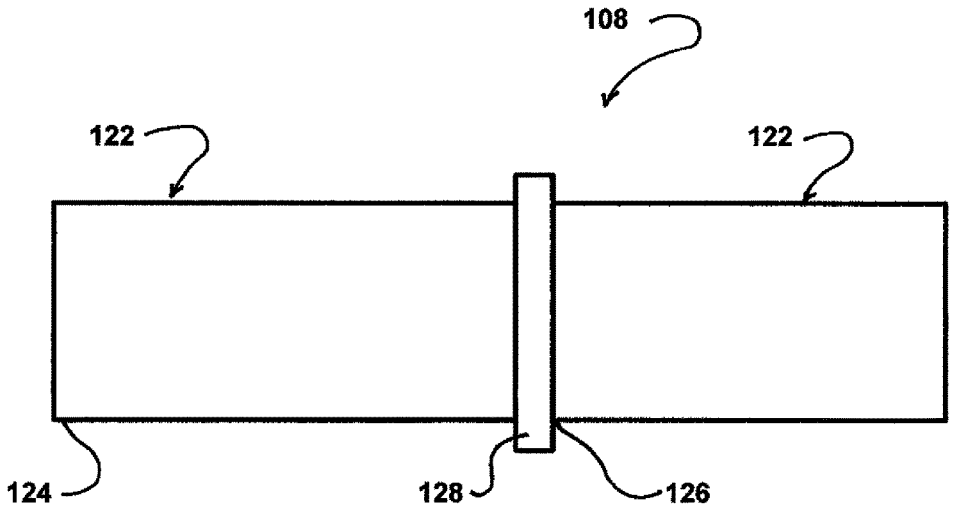
FIG. 10 is a schematic representation of another preferred embodiment of the invention showing the elongated conduit comprising two or more removable sections that can be attached together or removed to provide different length of conduit.
Figure 11:
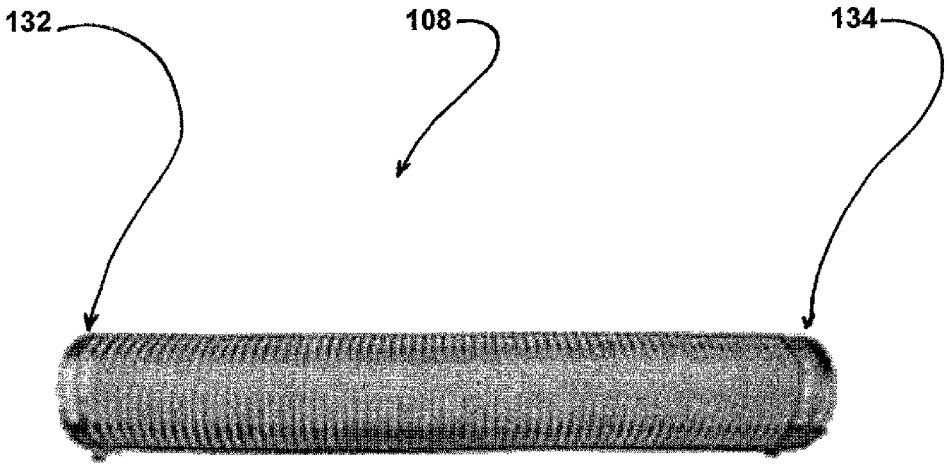
FIG. 11 is a representation illustrating another preferred embodiment of the bed warmer system having the elongated conduit in the form of an articulated hose, such as a hose comprising wire helixes supporting an outer sheath, and having includes an attachment at one end for connecting additional sections and a warm air generator attachment for connecting to the cool air inlet of the warm air generator.

In another preferred embodiment the elongated conduit 108 is formed from a plastic material and can be adjusted to various lengths. In one non-limiting example, as illustrated in FIGS. 8 and 9, the elongated conduit is in the form of a telescoping conduit such that a user can adjust the length of the conduit. As shown in FIG. 8, the elongated conduit 108 is in a shortened configuration and, as shown in FIG. 9 the elongated conduit 108 is shown in its extended position. In another non-limiting example, as illustrated in FIG. 10, the elongated conduit 108 is shown comprising two or more removable sections 122 that can be attached together or removed to provide different length of conduit 108. As shown, the individual sections 122 each having a male attachment end 124 and a female attachment end 126, such as by use of a frictional fit ring 128, that operate to mate with another individual section 122, such that the male attachment end 124 of one section 122 slidably mates with the female attachment ring 128 of the female attachment end 126 of another section 122 thereby lengthening the elongated conduit 108. In another non-limiting example, as illustrated in FIG. 11, the elongated conduit 108 is in the form of an articulated hose, such as a hose comprising wire helixes supporting an outer sheath. In a preferred embodiment the elongated conduit 108 includes an attachment 132 at one end for connecting additional sections 122 and a warm air generator attachment 134 for connecting to the cool air inlet 104 of the warm air generator 102.

It should be understood that the elongated conduit can be formed from various materials such as a plastic material and can be flexible, such as in the form of an articulated hose or a relatively soft plastic hose or can be rigid, such as when formed from a PVC material, such as a tubular PVC conduit. It should be understood that other flexible and rigid conduits can be utilized that are removably mounted to the air cool air inlet of the warm air generator and having a length sufficient for permitting the warm air generator to be placed above the bed sheet and below the bed cover and during operation directs warm air into the envelope of space between the bed sheet and bed cover and permits the second end of the elongated conduit to be placed such that it is not directly under the bed cover or directly above the bed sheet. It should also now be understood that the elongated conduits can be permanently attached to the cool air inlet of the warm air generator or can be removably attached to the cool air inlet of the warm air generator such as by use of a sleeve, such as an elastic sleeve; or by the use of clamps and other conventional systems.

Figure 12:
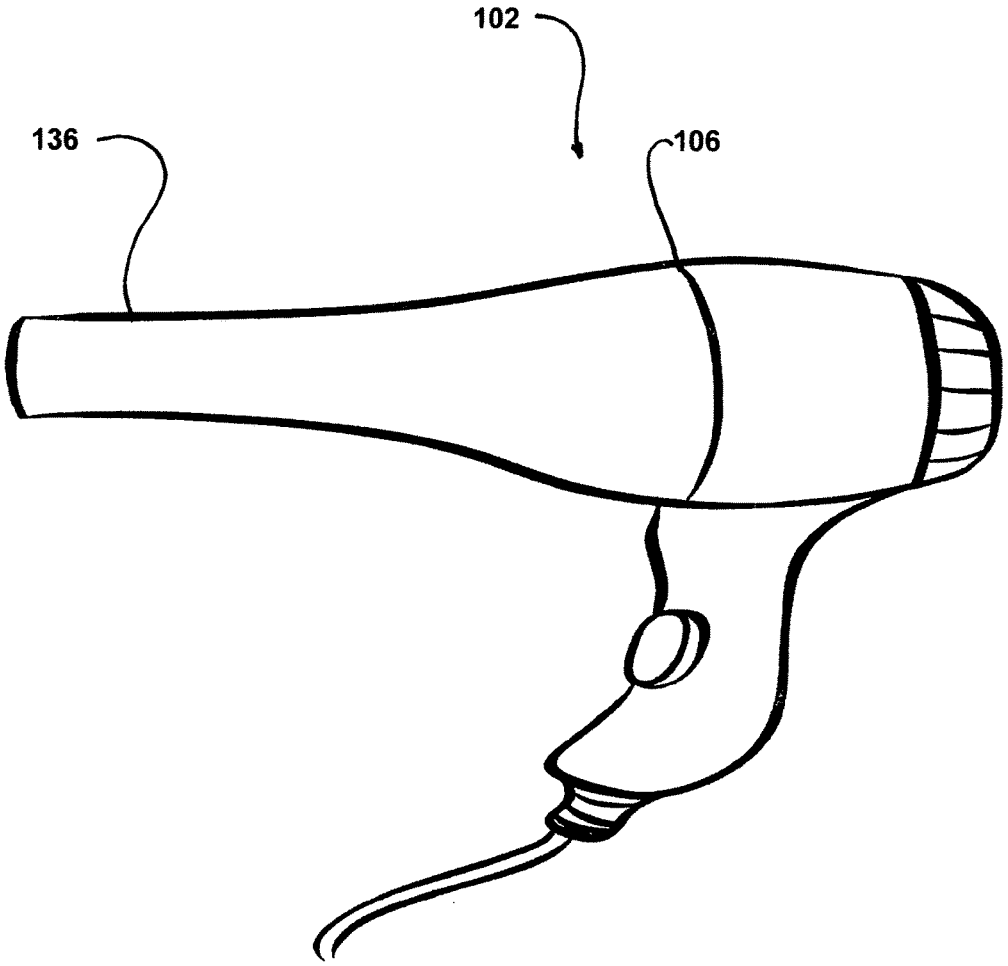
FIG. 12 is a schematic representation of another preferred embodiment of the invention showing the warm air generator having a warm air outlet extender frictionally mated with to the warm air outlet.
Figure 13:
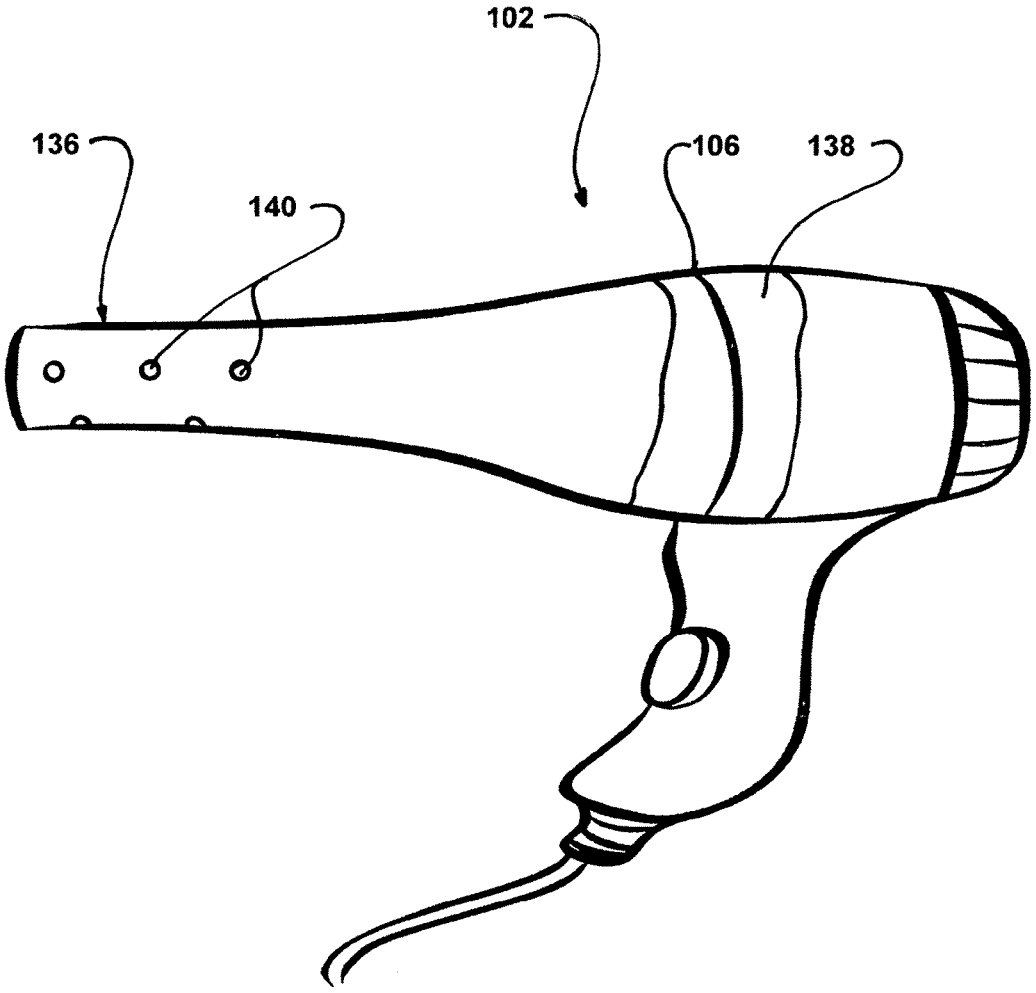
FIG. 13 is a schematic representation of another preferred embodiment of the invention showing the warm air generator having a warm air outlet extender attached to the warm air outlet by an elastic sleeve.

Another preferred embodiment of the invention is illustrated in FIG. 12 the bed warming system 100 includes a warm air outlet extender 136 connected to the to the warm air outlet 106 of the warm air generator 102. In a preferred embodiment, the proximal end of the warm air outlet extender 136 is sized to mate with the warm air outlet 106 forming a frictional fit. It should be understood that other systems and devices may be utilized for attaching the warm air outlet extender with the warm air outlet to direct warm air into the envelop 200. In another preferred embodiment of the invention, as illustrated in FIG. 13, the warm air outlet extender 136 is connected to the warm air outlet 106 of the warm air generator 102 by use of an elastic sheath 138 that operates to maintain the connection of the warm air outlet extender 136 to the warm air outlet 106. Preferably, the elastic sleeve 138 is formed from a heat resistant material, such as a silicone, having sufficient thickness to provide insulation thereby reducing the likelihood that a user could be hurt or burnt by touching the warm air outlet of the warm air generator. In another preferred embodiment of the invention, the warm air outlet extender 136 includes a plurality of apertures 140 for directing warm air in different directions within the envelope 200. In another preferred embodiment the plurality of apertures 140 are angled to further direct the warm air in various directions.

As described, the subject invention is a portable bed warming system that overcomes the disadvantages of the systems and devices of the prior art. In use, the warm air generator is easily inserted under the cover of a bed and can be easily removed without having to remove the bed cover by simply lifting up the bed cover and sliding the warm air generator under the bed cover above the bed sheet such that the second end of the elongated conduit is exposed to the ambient air (not directly under the bed cover or directly above the bed sheet. In a preferred embodiment, depending on the size of the bed and the placement of the warm air generator under the bed cover, the elongated conduit can be adjusted in length.

In a preferred embodiment the bed warmer system of the subject invention utilizes a conventional hair dryer for use as the warm air generator. It should now be understood to one skilled in the art that the use of a conventional hair dryer provides a bed warmer that is relatively light weight, compact, and can quickly and effectively heat up the space between a bed sheet and a bed cover and is relatively inexpensive to manufacture. Further, the use of an elongated conduit attached to the cool air inlet of the hair dryer (warm air generator) permits warm air to be directed into the envelope formed between the bed sheet and cover without cooling of the air, thereby maintaining the efficiency of the warm air generator (no cooling of the warm air) while permitting cool ambient air to be directed into the cool air inlet of the warm air generator thereby keeping the warm air generator (hair dryer) operating within predefined operating specifications.

Figure 14:
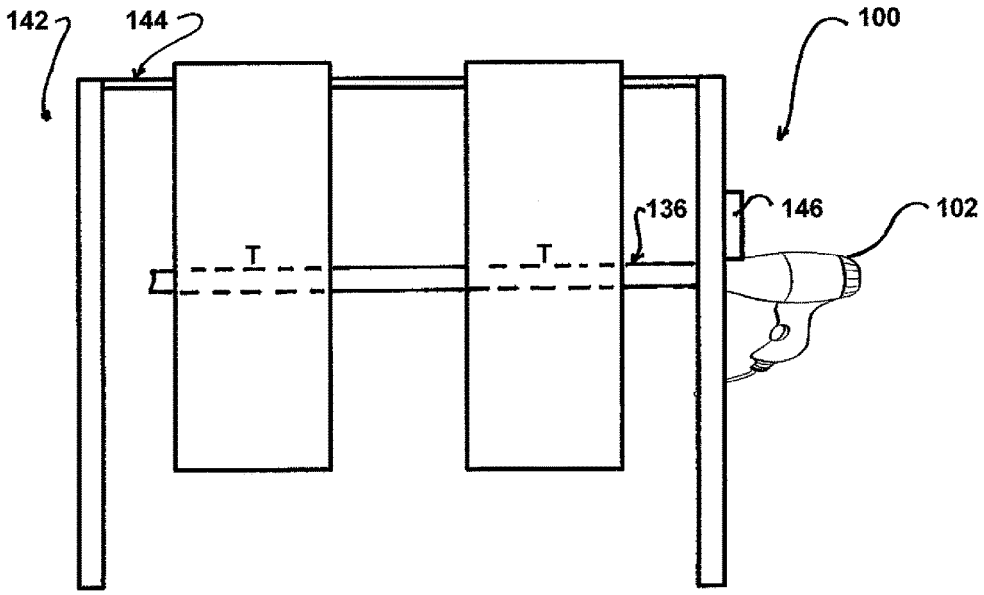
FIG. 14 is a schematic side illustration of the bed warming system of the subject invention mounted to a stand having a bar for hanging one or more towels thereon and operates such that warm air is expelled through the plurality of apertures in the warm air outlet extender to heat the air in the envelop formed by the one or more towels.
Figure 15:
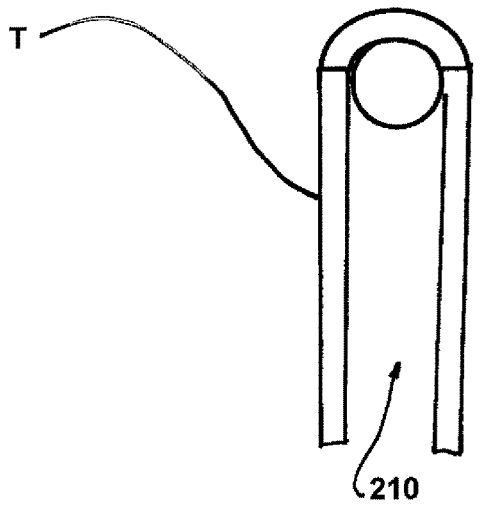
FIG. 15 is a schematic front illustration of the bed warming system of FIG. 14 showing an envelope formed by a towel being heated.

It should also now be apparent that the bed warming system can be utilize to warm other items, such as sleeping bags, bath robes or blankets. For an illustrated non-limiting example, as illustrated in FIGS. 14 and 15, the bed warming system 100 is mounted to a stand 142 having a bar 144 for hanging one or more towels T thereon. The warm air generator 102 is removably mounted to the stand 142 by a coupling 144, such as by a support, clamps, or other conventional means, such that the warm air outlet extender 136 projects outwardly in parallel relationship with bar 146 such that warm air is expelled through the plurality of apertures 140 to heat the air in the envelop 210 formed by the one or more towels T. In this way one or more towels can be warmed, such as just prior to a person using the towel after a bath or shower or for drying a towel after use. It should be understood that while towels were used in this non-limiting example, other items, such as jackets, coats, sweaters, socks and the like can also be heated (or dryed) by the bed warmer of the subject invention.

Further, the warm air generator can be sized for different application and can utilize various electric systems 120 for supply power to the warm air generator 102. For example, depending on the use, the electric power system utilized by the bed warming system can be a conventional electric plug or can be a battery, such as a battery pack having replaceable or rechargeable batteries separate from or integrated with the bed warming system.

It should now also be understood that the bed warming system of the subject invention provides a new and novel system for warming a bed. Although the foregoing invention has been described in some detail for purposes of clarity of understandings, it will be apparent that certain changes and modifications may be practiced within the scope of the appended claims. It should now be apparent that the various embodiments presented can be easily modified while keeping within the scope and spirit of the subject invention. Accordingly, it should be understood that the present disclosure is to be considered as exemplary of the principals of the invention and is not intended to limit the invention to the embodiments and the specific examples illustrated and the invention is not to be limited to the details given herein, but may be modified within the scope and equivalents of the descriptions and examples contained herein.

The invention claimed is:

1. A bed warming system for use on a bed having a bed sheet and a bed mattress, the bed warming system for heating the envelope formed between the surface of a bed sheet that a person sleeps above and a cover laying over the bed sheet and which overhangs the bed sheet and the mattress, the bed warming system comprising:

a warm air generator having a heating element, a cool air inlet and a warm air outlet; and an elongated conduit having a first end connected to said cool air inlet for directing cool ambient air to said warm air generator and a second end for receiving cooling air;

wherein said elongated conduit is adjustable to various lengths such that when said warm air generator is placed entirely above the surface of the bed sheet and positioned entirely under the cover the length of said elongated conduit can be adjusted such that said second end of said elongated conduit is exposed and not under the cover.

2. The bed warming system of claim 1 wherein said elongated conduit includes a plurality of air holes that operate to permit cool air to enter said elongated conduit.

3. The bed warming system of claim 1 wherein said elongated conduit is removably attached to said cool air inlet of said warm air generator.

4. The bed warming system of claim 1 further comprising a timing system that operates to turn off the warm air generator after a predefined amount of time.

5. The bed warming system of claim 1 further comprising a temperature sensor that operates to turn off said warm air generator when the air temperature in the envelop formed between the cover and the bed sheet reaches a predefined temperature.

6. The bed warming system of claim 1 further comprising a temperature sensor that operates to turn off said warm air supply generator if the temperature within said warm air generator reaches a predefined temperature.

7. The bed warming system of claim 1 wherein said elongated conduit is formed from a flexible material capable of being bent or curved.

8. The bed warming system of claim 1 wherein said elongated conduit is attached to said warm air generator by a flexible sleeve.

9. The bed warming system of claim 1 wherein said first end of said elongated conduit includes an attachment effective for removably attaching to said cool air inlet.

10. A bed warming system for heating the envelop formed between the surface of a bed sheet that a person sleeps above and covering a bed mattress and a cover laying over the bed sheet, the bed warming system comprising:

a warm air generator having a heating element, a cool air inlet and a warm air outlet; and an elongated flexible conduit removably attached to said warm air generator and operates to direct cool ambient air to said warm air generator;

wherein said warm air generator receives said cool ambient air and heats said cool ambient air and discharges said heated air in the envelope; wherein the length of said elongated conduit is adjustable such that when said warm air generator is placed entirely under the cover and entirely above the surface of the bed sheet, the length of said elongated conduit is adjusted such that a portion of said elongated conduit is exposed and not under the cover and is effective for receiving cool ambient air.

11. The bed warming system of claim 10 wherein said elongated conduit includes a plurality of air holes that operate to permit cool air to enter said elongated conduit.

12. The bed warming system of claim 10 further comprising a timing system that operates to turn off the warm air generator after a predefined amount of time.

13. The bed warming system of claim 10 further comprising a temperature sensor that operates to turn off said warm air generator when the air temperature in the envelop formed between the cover and the bed sheet reaches a predefined temperature.

14. The bed warming system of claim 10 further comprising a temperature sensor that operates to turn off said warm air supply generator if the temperature within said warm air generator reaches a predefined temperature.

15. The bed warming system of claim 10 wherein said elongated conduit is formed from a flexible material capable of being bent or curved.

* * * * *